US006039363A

United States Patent [19]

Sugimura et al.

[11] Patent Number: 6,039,363

[45] Date of Patent: Mar. 21, 2000

[54] DOOR LOCKING HANDLE ASSEMBLY OF PULL-OUT AND SIDE-SWINGING LEVER-ACTION TYPE

[75] Inventors: Atsurou Sugimura; Yoshihide Tuno, both of Tokyo, Japan

[73] Assignee: Takigen Manufacturing Co. Ltd., Tokyo, Japan

[21] Appl. No.: 09/431,038

[22] Filed: Oct. 30, 1999

[30] Foreign Application Priority Data

Dec. 22, 1998 [JP] Japan ..... 10-364724

[51] Int. Cl.[7] ..... E05C 3/04

[52] U.S. Cl. ..... 292/202; 292/200; 292/336.3; 292/DIG. 31; 70/208

[58] Field of Search ..... 292/200, 336.3, 292/DIG. 31, 194, DIG. 30, 202; 70/208

[56] References Cited

U.S. PATENT DOCUMENTS

| | | | |
|---|---|---|---|
| 5,347,834 | 9/1994 | Ramsauer | 70/120 |
| 5,440,905 | 8/1995 | Yamada | 70/208 |
| 5,450,734 | 9/1995 | Esaki et al. | 70/208 |
| 5,450,735 | 9/1995 | Esaki et al. | 70/208 |
| 5,452,596 | 9/1995 | Yamada | 70/208 |
| 5,454,239 | 10/1995 | Esaki et al. | 70/208 |
| 5,457,971 | 10/1995 | Yamada | 70/208 |
| 5,469,725 | 11/1995 | Yamada | 70/208 |
| 5,685,181 | 11/1997 | Ramsauer | 70/208 |
| 5,722,269 | 3/1998 | Simon et al. | 70/208 |
| 5,893,282 | 4/1999 | Runge et al. | 70/208 |

*Primary Examiner*—Teri Pham
*Attorney, Agent, or Firm*—Martin Smolowitz

[57] ABSTRACT

In a door handle assembly: the number of parts of a handle holding mechanism for holding a handle (10) in its retracted, its projected and its swung position is reduced to the lowest possible one to accomplish its cost reduction, its downsizing and its improvement in handle holding power; a leaf spring (11) constructed of a pair of its elements stacked together is non-rotatably mounted on a boss (7) of a main pin (3) having a concave portion (13) in its front surface; the handle (10) with an engaging projection (14) is brought into abutting contact with the leaf spring (11); in its folded position, the handle (10) has its top portion (14*a*) oppositely disposed from its grip portion (15) with respect to a reference line (39) extending perpendicular to a door surface; in its projected position, the handle (10) has the top portion (14*a*) move across the line (39); a front element of the spring (11) has a pair of upwardly protruding portions (33, 34) be engageable with and disengageable from engaging grooves (31, 32) of a first (14*a*) and a second (14*c*) oblique surfaces of the engaging projection (14).

5 Claims, 6 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like containing various instruments therein, for locking, unlocking, opening and closing its door.

2. Description of the Prior Art

Already disclosed in Japanese Patent No. 2504714 is a conventional door locking handle assembly of a pull-out and side-swinging lever-action type. This conventional door locking handle assembly comprises: a stationary casing fixedly mounted on a door, the stationary casing being provided with a recess in its front surface and a cylindrical portion in its base-end portion, wherein the cylindrical portion projects rearward from a rear surface of the base-end portion; a main pin rotatably mounted in the cylindrical portion of the base-end portion of the stationary casing in an insertion manner, the main pin being non-axially slidable in the cylindrical portion and having its rear-end portion fixed to a catch plate, wherein the catch plate is engaged with and disengaged from a receiving portion of a stationary frame element, and the main pin is provided with a connecting boss portion in its front-end portion; and a control handle which has its base-end portion pivoted to the connecting boss portion of the main pin through a cross pivot so that the control handle is foldable into and projectable from the recess in the stationary casing, whereby the control handle is side-swingable in its projected position.

In this conventional door locking handle assembly, in order to hold the control handle in each of: its retracted position in which the control handle is fully received or embedded in the recess of the stationary casing; its projected or pulled-out position in which the control handle is pulled out of the recess in the stationary casing; and its side-swung or -turned position in which the control handle is turned toward its unlocked position, there is further provided a compression coil spring for urging a spring shoe plate forward, wherein: the compression coil spring is received in a hollow portion provided behind the spring shoe plate which is provided with a central through-hole; the connecting boss portion of the main pin is inserted into the central through-hole of the spring shoe plate so that the spring shoe plate is non-rotatably mounted on the connecting boss portion of the main pin; the spring shoe plate is provided with a cross-shaped ridge portion in its front surface, which ridge portion is for a click, wherein the ridge portion is engaged with and disengaged from a T-shaped groove portion in the rear surface of the base-end portion of the control handle in accordance with one of the changeable positions of the control handle. Consequently, in the conventional door locking handle assembly having the above construction, the control handle may change its position with a click. The above door locking handle assembly is a conventional handle holding mechanism for holding the control handle in each of its changeable positions.

However, the conventional handle holding mechanism described above suffers from the following problem: namely, in the conventional mechanism, both the compression coil spring and the spring shoe plate are essential components, and therefore can't be omitted therefrom. Further, in the conventional mechanism, it is necessary to provide a large hollow portion in the cylindrical portion of the base-end portion of the stationary casing for receiving therein both the spring shoe plate and the compression coil spring, because the spring shoe plate and the compression coil spring are relatively large in thickness and in height, respectively, which makes it impossible to downsize the conventional mechanism.

SUMMARY OF THE INVENTION

Consequently, it is an object of the present invention to provide a door locking handle assembly of a pull-out and side-swinging lever-action type, wherein the number of components of its handle holding mechanism for holding a control handle in its retracted, its projected and its swung position is reduced to the lowest possible one to reduce in height a cylindrical portion formed in a base-end portion of a stationary casing, which makes it possible to downsize the door locking handle assembly as a whole and to improve the assembly in handle holding power.

According to the present invention, the above object of the present invention is accomplished by providing:

a door locking handle assembly of a pull-out and side-swinging lever-action type, comprising:

a stationary casing fixedly mounted on a door, the stationary casing being provided with a recess in its front surface and a cylindrical portion in its base-end portion, wherein the cylindrical portion projects rearward from a rear surface of the base-end portion;

a main pin rotatably mounted in the cylindrical portion of the base-end portion of the stationary casing in an insertion manner, the main pin being non-axially slidable in the cylindrical portion and having its rear-end portion fixed to a catch plate, wherein the catch plate is engaged with and disengaged from a receiving portion of a stationary frame element, and the main pin is provided with a connecting boss portion in its front-end portion;

a control handle which has its base-end portion pivoted to the connecting boss portion of the main pin through a cross pivot so that the control handle is foldable into and projectable from the recess in the stationary casing, whereby the control handle is side-swingable in its projected position;

a laminated leaf spring constructed of a pair of an upper and a lower spring element stacked together, wherein the laminated leaf spring is provided with a central through-hole through which the laminated leaf spring is fixedly mounted on the connecting boss portion of the main pin, the upper spring element of the laminated leaf spring being provided with a pair of upwardly protruding portions which are diametrically opposite to each other so as to have the central through-hole disposed therebetween, wherein a front surface of the main pin faces a rear surface of the laminated leaf spring and is curved rearwardly to form a concave portion;

an engaging projection which is provided in a rear surface of the base-end portion of the control handle and brought into abutting contact with a front surface of the laminated leaf spring, wherein after the control handle including its grip portion is entirely received in the recess in the stationary casing and the engaging projection has its top portion positioned in a position oppositely disposed from the grip portion of the control handle with respect to a reference line extending in a direction perpendicular to a front surface of the door, when the control handle is pulled out of the recess in stationary casing, the top portion of the engaging projection of the control handle moves across the reference line;

a first engaging groove portion which is provided in a first oblique surface of the engaging projection of the control handle and engaged with the engaging upwardly protruding portions of the laminated leaf spring when the control handle projects from the stationary casing; and a second engaging groove portion which is provided in a second oblique surface of the engaging projection of the control handle and engaged with the upwardly protruding projections of the laminated leaf spring when the control handle folds into the recess in the stationary casing.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENTS

Figure 1:
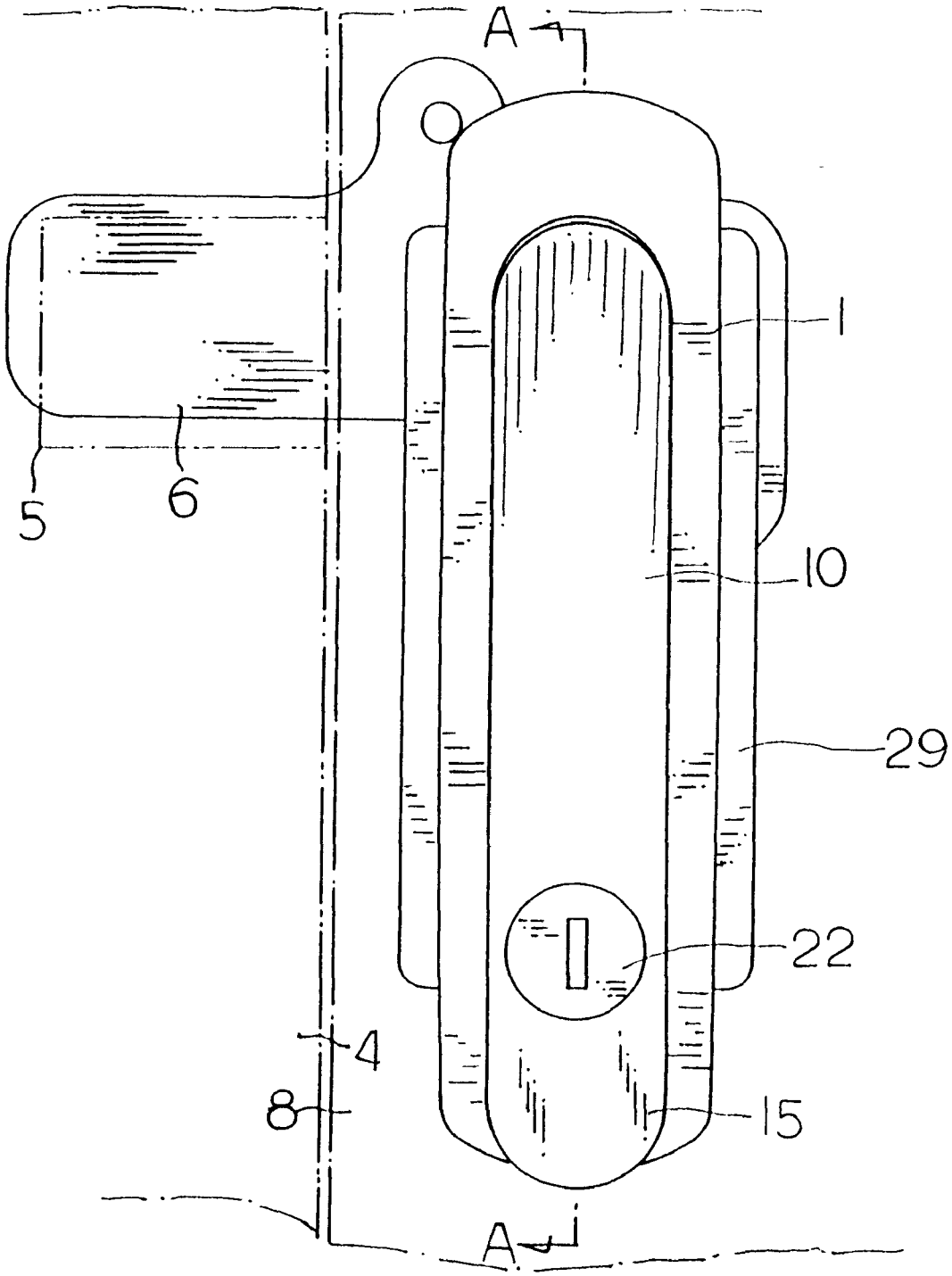
FIG. 1 is a front view of an embodiment of the door locking handle assembly of a pull-out and side-swinging lever-action type of the present invention in a condition in which the door is locked.
Figure 2:
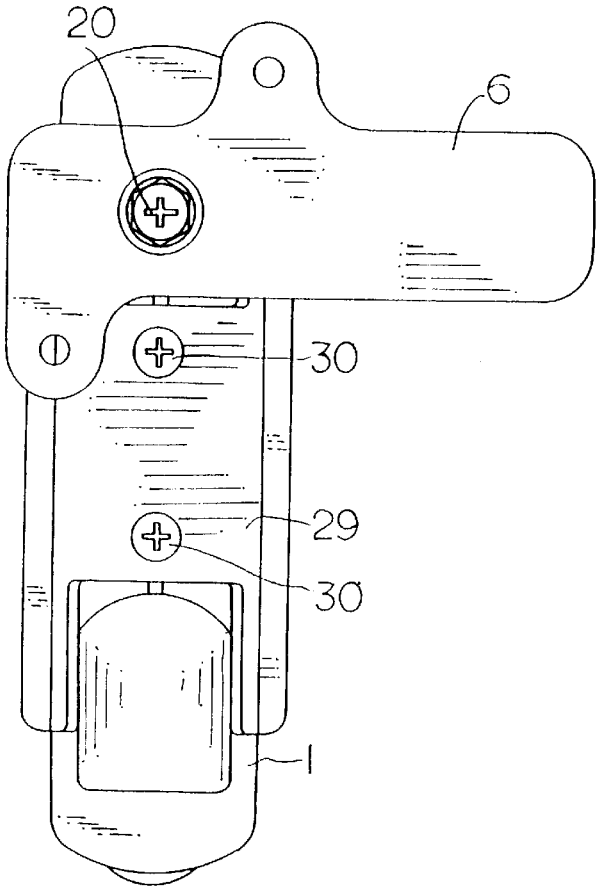
FIG. 2 is a rear view of the door locking assembly of the present invention show in FIG. 1.
Figure 3:
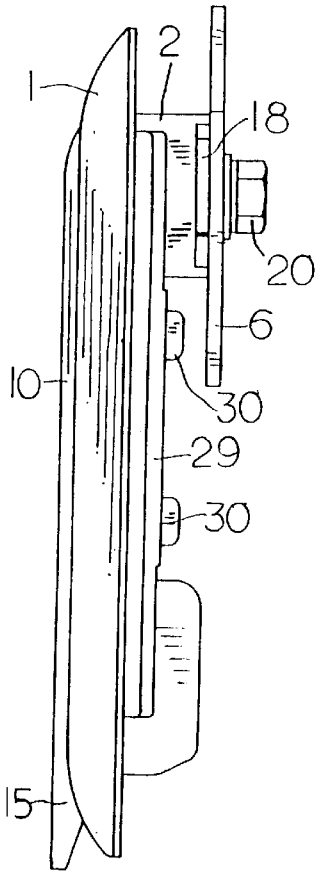
FIG. 3 is a right-side view of the door locking assembly of the present invention shown in FIG. 1.
Figure 4:
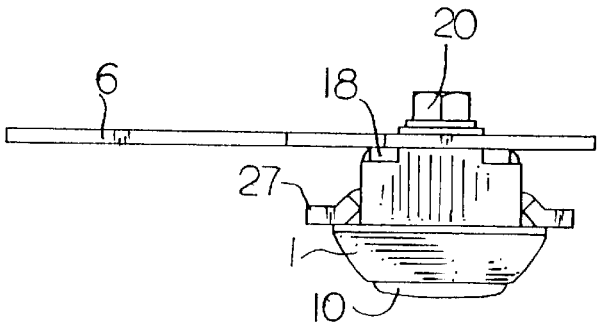
FIG. 4 is a plan view of the door locking assembly of the present invention shown in FIG. 1.

The best modes for carrying out the present invention will be described in detail using embodiments of the present invention with reference to the accompanying drawings.

Hereinbelow, the present invention will be described in detail with reference to the accompanying drawings and the reference numerals and characters.

In a door locking handle assembly of a pull-out and side-swinging lever-action type, a stationary casing 1 is fixedly mounted on a door 8. This stationary casing 1 is provided with a recess in its front surface and a cylindrical portion 2 in its base-end portion. This cylindrical portion 2 projects rearward from a rear surface of the base-end portion of the stationary casing 1. A main pin 3 is rotatably mounted in the cylindrical portion 2 of the base-end portion of the stationary casing 1 in an insertion manner. The main pin 3 is non-axially slidable in the cylindrical portion 2 and has its rear-end portion fixed to a catch plate 6. This catch plate 6 is engaged with and disengaged from a receiving portion 5 of a stationary frame element 4. The main pin 3 is provided with a connecting boss portion 7 in its front-end portion. On the other hand, a control handle 10 has its base-end portion pivoted to the connecting boss portion 7 of the main pin 3 through a cross pivot 9 passing through a through-hole 28 (shown in FIG. 13) of the control handle 10, so that the control handle 10 is foldable into and projectable from the recess in the stationary casing 1, whereby the control handle 10 is side-swingable in its projected position.

The door locking handle assembly of the present invention further comprises a laminated leaf spring 11, which is constructed of a pair of an upper and a lower spring element stacked together. The laminated leaf spring 11 is provided with a central through-hole 12 through which the laminated leaf spring 11 is fixedly mounted on the connecting boss portion 7 of the main pin 3. The upper spring element of the laminated leaf spring 11 is provided with a pair of upwardly protruding portions 33, 34 which are diametrically opposite to each other so as to have the central through-hole 12 disposed therebetween. A front surface of the main pin 3 faces a rear surface of the laminated leaf spring 11 and is curved rearwardly to form a concave portion 13. An engaging projection 14 is provided in a rear surface of the base-end portion of the control handle 10, and brought into abutting contact with a front surface of the laminated leaf spring 11.

After the control handle 10 including its grip portion 15 is entirely received in the recess in the stationary casing 1 and the engaging projection 14 has its top portion 14*a* positioned in a position oppositely disposed from the grip portion 15 of the control handle 10 with respect to a reference line 39 extending in a direction perpendicular to a front surface of the door 8, when the control handle 10 is pulled out of the recess of the stationary casing 1, the top portion 14*a* of the engaging projection 14 of the control handle 10 thus pulled out moves across the reference line 39. On the other hand, a first engaging groove portion 31 is provided in a first oblique surface 14*b* of the engaging projection 14 of the control handle 10 and engaged with the engaging upwardly protruding portions 33, 34 of the laminated leaf spring 11 when the control handle 10 projects from the stationary casing 1. A second engaging groove portion 32 is provided in a second oblique surface 14*c* of the engaging projection 14 of the control handle 10 and engaged with the upwardly protruding portions 33, 34 of the laminated leaf spring 11 when the control handle 10 folds into the recess of the stationary casing 1.

Figure 13:
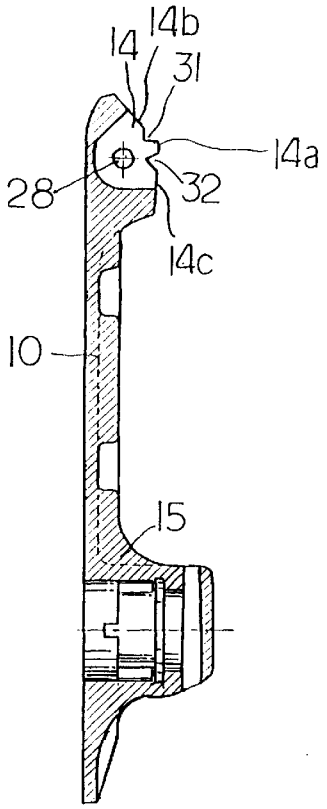
FIG. 13 is a longitudinal sectional view of the door handle of the door locking assembly of the present invention shown in FIG. 1.
Figure 14:
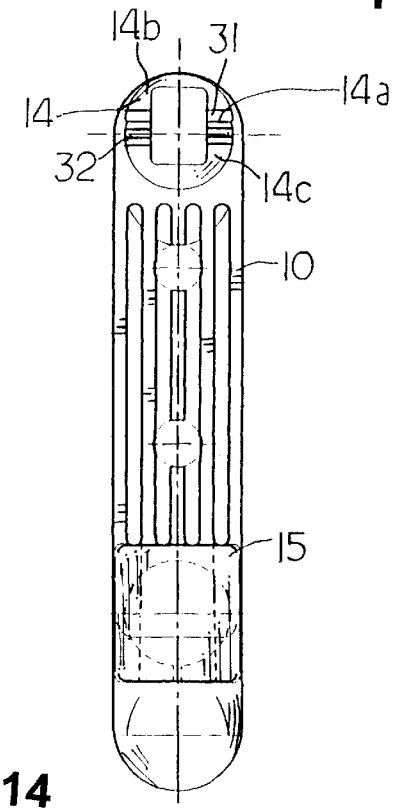
FIG. 14 is a rear view of the door handle of the door locking assembly of the present invention shown in FIG. 1.

In the door locking handle assembly of the present invention having the above construction, in a condition in which the control handle 10 including its grip portion 15 is received in the recess of the stationary casing 1 as a whole, the second engaging portion 32 formed in the second oblique surface 14*c* of the engaging projection 14 in the control handle 10 as shown in FIG. 13 is engaged with the upwardly protruding portions 33, 34 of the front spring element in the laminated leaf spring 11. At this time, the top portion 14*a* of the engaging projection 14 in the control handle 10 is brought into abutting contact with the upper spring element of the laminated leaf spring 11 in the side opposite to the grip portion 15 of the control handle 10 with respect to the reference line 39 which passes through the cross pivot 9 to extend in a direction perpendicular to the surface of the door 8. Due to the above construction, the laminated leaf spring 11 exerts its resilient force on the top portion 14*a* of the engaging projection 14 of the control handle 10 to produce counterclockwise torque in the control handle 10 about the cross pivot 9, as viewed in FIG. 13. As a result, due to the presence of the resilient force exerted by the laminated leaf spring 11, the grip portion 15 of the control handle 10 is resiliently urged to a bottom surface of the recess of the stationary casing 1, so that the control handle 10 is resiliently held in its retracted position within the recess of the stationary casing 1.

Figure 5:
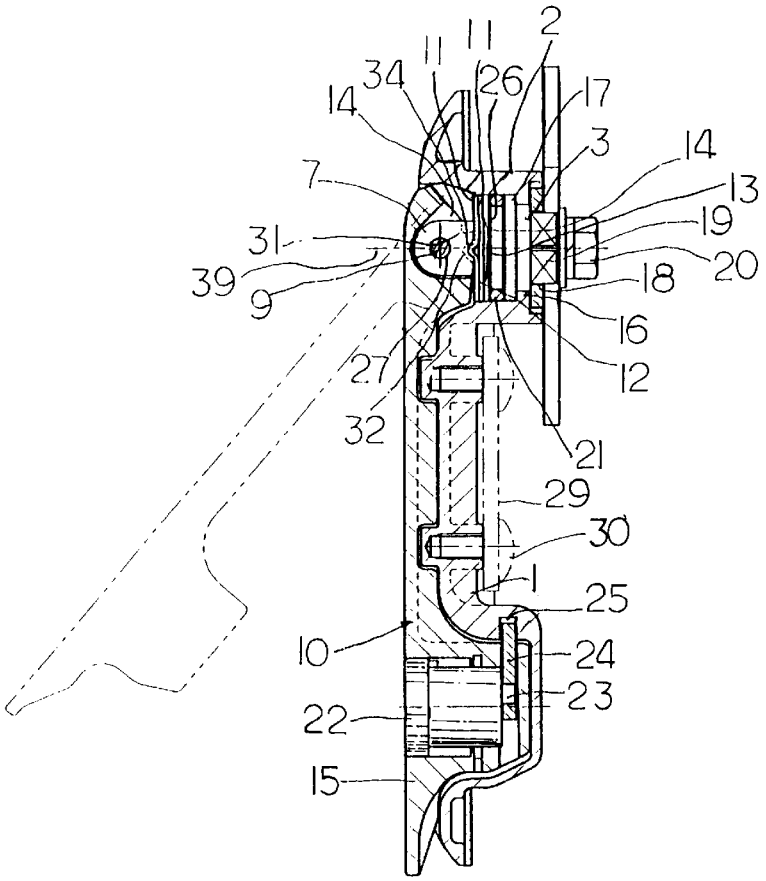
FIG. 5 is a longitudinal sectional view of the door locking assembly of the present invention, taken along the line A—A of FIG. 1.
Figure 8:
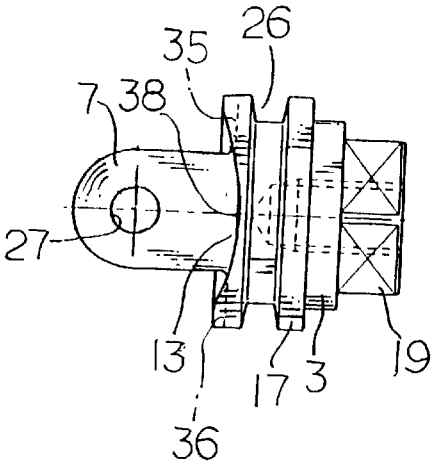
FIG. 8 is a right-side view of the main pin of the door locking assembly of the present invention shown in FIG. 1.

When the control handle 10 is pulled out of the recess of the stationary casing 1 so that the top portion 14*a* of the engaging projection 14 of the control handle 10 moves across the reference line 39 to reach the side of the grip portion 15 of the control handle 10 with respect to the reference line 39, as viewed in FIG. 5, the resilient force exerted by the laminated leaf spring 11 acts on the control handle 10 to rotate the same clockwise about the cross pivot 9. Thereafter, when the control handle 10 is pulled out of the recess of the stationary casing 1 to reach a predetermined projected position thereof, the first oblique surface 14*b* of the engaging projection 14 of the control handle 10 is brought into abutting contact with an upper half portion of the laminated leaf spring 11 so that the first engaging groove portion 31 of the first oblique surface 14*b* engages with the upwardly protruding portions 33, 34 of the upper spring element of the laminated leaf spring 11, which makes it possible to firmly hold the control handle 10 in its predetermined projected position, as viewed in FIG. 5. At this time, when the top portion 14*a* of the engaging projection 14 of the control handle 10 moves across the reference line 39, the laminated leaf spring 11 is resiliently deformed to the maximum within the concave portion 13 (shown in FIG. 8) of the main pin 3.

Then, when the user grips the grip portion 15 of the control handle 10 thus projected forward and side-swings or -turns the control handle 10 about the main pin 3, the catch plate 6 is disengaged from the receiving portion 5 of the stationary frame element 4 so that the door 8 is unlocked from the stationary frame element 4, which enables the user to open the door 8 by pulling its control handle 10 forward.

Incidentally, when the control handle 10 is side-swung or turned to the unlocking position of the door 8 as described above, the first oblique surface 14*b* of the engaging projection 14 slides on the front surface of the laminated leaf spring 11 so that the leaf spring 11 still exerts its resilient force on the control handle 10 to hold the same in its predetermined projected position.

Figure 6:
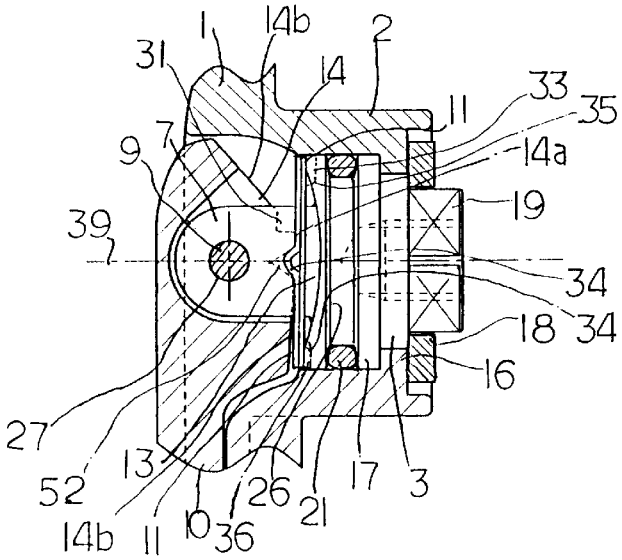
FIG. 6 is an enlarged view showing in cross section a connecting portion of the main pin, through which portion the main pin is connected with the door handle employed in the door locking assembly of the present invention shown in FIG. 1.

In the above embodiment of the present invention, the main pin 3 has a lower axial surface of its intermediate shoulder portion 17 brought into abutting contact with an upper axial surface of a flange portion 16 formed in an inner peripheral surface of the cylinder portion 2 of the base-end portion of the stationary casing 1, so that the main pin 3 is prevented from moving rearward relative to the stationary casing 1. Further, the main pin 3 has its rear-end square pin portion 18 fixedly fitted in a square central through-hole of a turning angle control disc 18, an upper axial surface of which disc 18 is brought into abutting contact with a lower axial surface of the flange portion 16 of the stationary casing 1 to prevent the main pin 3 from moving forward relative to the stationary casing 1. The catch plate 6 is provided with a central through-hole assuming a square shape. Fitted in both these central through-holes of the turning angle control disc 18 and the catch plate 6 is the rear-end square pin portion 19 of the main pin 3 to prevent the main pin 3 from rotating relative to both the turning angle control disc 18 and the catch plate 6, both of which are fixedly mounted on the main pin 3 by a fastener, for example such as bolt 20. On the other hand, as shown in FIG. 6, the connecting boss portion 7 of the main pin 3 assumes a square shape in cross section. A pivot through-hole 27 is formed in the connecting boss portion 7 of the main pin 3 to extend in a direction perpendicular to the longitudinal axis of the main pin 3. The laminated leaf spring 11 is constructed of the pair of the leaf spring elements each constructed of a disc provided with the central through-hole assuming a square shape. As is clear from FIG. 8, the main pin 3 is provided with an annular groove 26 in an outer peripheral surface of its intermediate portion.

As shown in FIG. 5, a watertight O-ring 21 is fitted in the annular groove 26 of the main pin 3.

Figure 7:
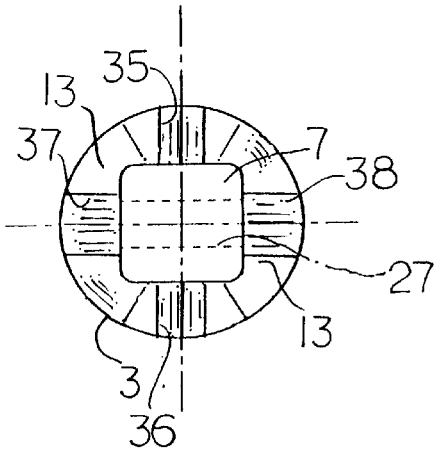
FIG. 7 is an enlarged front view of the main pin employed in the door locking assembly of the present invention shown in FIG. 1.
Figure 9:
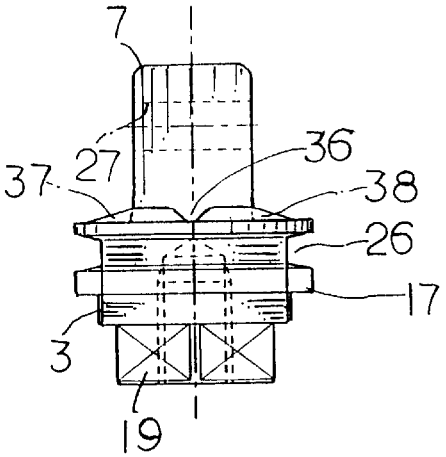
FIG. 9 is a bottom view of the main pin of the door locking assembly of the present invention shown in FIG. 1.
Figure 10:
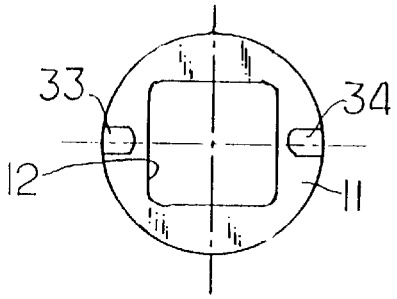
FIG. 10 is a front view of the leaf spring employed in the door locking assembly of the present invention shown in FIG. 1.
Figure 11:
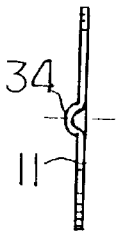
FIG. 11 is a right-side view of the leaf spring employed in the door locking assembly of the present invention shown in FIG. 1.
Figure 15:
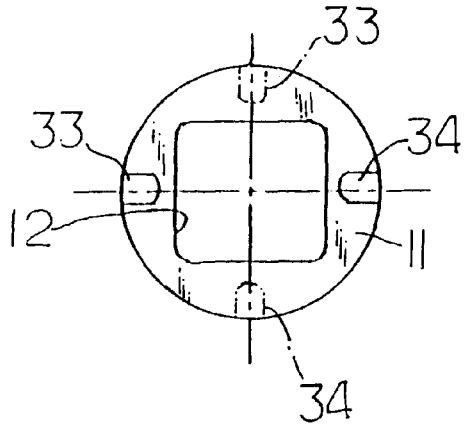
FIG. 15 is a front view of a pair of the leaf springs employed in the door locking assembly of the present invention shown in FIG. 1, wherein these leaf springs are neatly stacked together.
Figure 16:
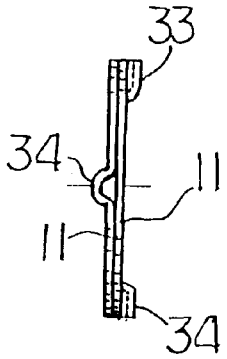
FIG. 16 is a right-side view of the thus stacked leaf springs of the door locking assembly of the present invention shown in FIG. 1.

As is clear from FIGS. 15, the lower spring element of the laminated leaf spring 11 is provided with a pair of rearwardly protruding portions 33, 34 (shown in dotted lines), wherein a line of diameter passing through the upwardly protruding portions 33, 34 (shown in solid lines in FIG. 15) of the upper spring element is arranged so as to be perpendicular to that of diameter passing through the rearwardly protruding portions 33, 34 (shown in dotted lines in FIG. 15) of the lower spring element of the laminated leaf spring 11. On the other hand, as shown in FIGS. 6 and 7, the concave portion 13 formed in the front surface of the main pin 3 assumes a sector shape. A pair of the thus formed sector-shaped concave portions 13 are symmetrically arranged about the central through-hole 12 (shown in FIG. 10) of the laminated leaf spring 11. Further formed in the front surface of the main pin 3 are a pair of V-shaped groove portions 35, 36 which are also symmetrically arranged about the connection boss portion 7 of the main pin 3. Further, in the front surface of the main pin 3, a line of diameter passing through the V-shaped groove portions 35, 36 is perpendicular to that of diameter passing through a pair of bottom portions 37, 38 of the concave portions 13, as is clear from FIGS. 8 and 9. Each of the diametrically opposing concave portions 13 is curved with a relatively large radius in formation to provide a sufficient room for receiving therein the laminated leaf spring 11 when the spring 11 is resiliently deformed to the maximum by the engaging projection 14 of the control handle 10. On the other hand, the pair of the upper one 35 and the lower one 36 (as viewed in FIG. 6) of the V-shaped groove portions 35, 36 are engaged with the pair of the upper one 33 and the lower one 34 (as shown in dotted lines in FIG. 15) of the rearwardly protruding portions 33, 34 of the lower spring element of the laminated leaf spring 11, which makes it possible to precisely position the laminated leaf spring 11.

Figure 12:
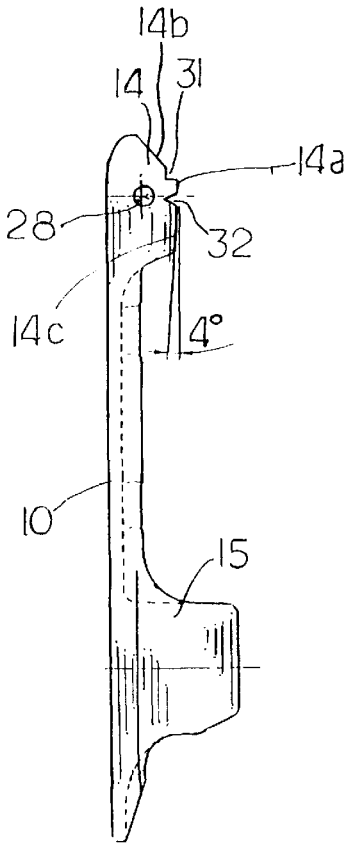
FIG. 12 is a right-side view of the door handle employed in the door locking assembly of the present invention shown in FIG. 1.

As shown in FIG. 12, the second oblique surface 14*c* of the engaging projection 14 of the control handle 10 is disposed in the side of the grip portion 15, and has an inclination of 4 degrees relative to the front surface of the control handle 10. Mounted in a front end portion of the grip portion 15 of the control handle 10 is a lock unit 22. When a rotor 23 of the lock unit 22 is rotated by a key (not shown) the lock plate 24 mechanically interlocked with the rotor 23 is engaged with a receiving portion 25 of the stationary casing 1, so that the control handle 10 is locked in its retracted or embedded position within the recess of the stationary casing 1. As is clear from FIG. 9, the pivot hole 28 of the control handle 10 extend in a direction perpendicular to the longitudinal axis of the main pin 3 to form a through-hole.

In installation, the stationary casing 1 is mounted on the door 8 so as to have its longitudinal axis be vertical. Then, as shown in FIG. 5, amounting plate 29 is abutted against a rear surface of the door 8 and fixedly mounted on the door 8 by means of a plurality of round-head screws 30 (shown in dotted lines) which are threadably engaged with the stationary casing 1, as is clear from FIG. 5, whereby the stationary casing 1 is fixedly mounted on the door 8.

As described above, in the door locking handle assembly of the present invention of the pull-out and side-swinging lever-action type, the handle holding mechanism for holding the control handle 10 in each of the retracted, side-swung or -turned, and the projected position thereof is constructed having only the laminated leaf spring 11 which is constructed of only one pair of the leaf spring elements, which makes it possible to remarkably reduce the number of components used in the handle holding mechanism and therefore makes it possible to realize the manufacturing-cost reduction.

Further, in the door locking handle assembly of the present invention, since no hollow portion for receiving therein the conventional compression coil spring is provided in the cylinder portion 2 of the base-end portion of the stationary casing 1, it is possible to reduce in height the cylindrical portion 2 of the stationary casing 1, which makes it possible to downsize the door locking handle assembly of the present invention as a whole.

Still further, as described above, the handle holding mechanism of the present invention is constructed of only the laminated leaf spring 11. Further, the engaging groove portions 31, 32 of the first oblique surface 14*b* and the second oblique surface 14*c* of the engaging projection 14 are engaged with the protruding portions 33, 34 of the laminated leaf spring 11. Consequently, it is possible to improve the handle holding mechanism of the present invention in its handle holding power, and also possible to precisely position and hold the control handle 10 in a predetermined position.

Finally, the present application claims the Convention Priority based on Japanese Patent Application No. Hei 10-364724 filed on Dec. 22, 1998, which is herein incorporated by reference.

What is claimed is:

1. A door locking handle assembly of a pull-out and side-swinging lever-action type, comprising:

a stationary casing (1) adapted to be fixedly mounted on a door (8), said stationary casing (1) being provided with a recess in its front surface and a cylindrical portion (2) in its base-end portion, wherein said cylindrical portion (2) projects rearward from a rear surface of said base-end portion;

a main pin (3) rotatably mounted in said cylindrical portion (2) of said base-end portion of said stationary casing (1) in an insertion manner, said main pin (3) being non-axially slidable in said cylindrical portion (2) and having its rear-end portion fixed to a catch plate (6), wherein said catch plate (6) is adapted to be engaged with and disengaged from a receiving portion (5) of a stationary frame element(4), and said main pin (3) is provided with a connecting boss portion (7) in its front-end portion;

a control handle (10) which has its base-end portion pivoted to said connecting boss portion (7) of said main pin (3) through a cross pivot (9) so that said control handle (10) is foldable into and projectable from said recess in said stationary casing (1), whereby said control handle (10) is side-swingable in its projected position;

a laminated leaf spring (11) constructed of a pair of an upper and a lower spring element stacked together, wherein said laminated leaf spring (11) is provided with a central through-hole (12) through which said laminated leaf spring (11) is fixedly mounted on said connecting boss portion (7) of said main pin (3), said upper spring element of said laminated leaf spring (11) being provided with a pair of upwardly protruding portions (33, 34) which are diametrically opposite to each other so as to have said central through-hole (12) disposed therebetween, wherein a front surface of said main pin (3) faces a rear surface of said laminated leaf spring (11) and is curved rearwardly to form a concave portion (13);

an engaging projection (14) which is provided in a rear surface of said base-end portion of said control handle (10) and brought into abutting contact with a front surface of said laminated leaf spring (11), wherein after said control handle (10) including its grip portion (15) is entirely received in said recess in said stationary casing (1) and said engaging projection (14) has its top portion (14*a*) positioned in a position oppositely disposed from said grip portion (15) of said control handle (10) with respect to a reference line (39) extending in a direction perpendicular to a front surface of said door (8), when said control handle (10) is pulled out of said recess in stationary casing (1), said top portion (14*a*) of said engaging projection (14) of said control handle (10) moves across said reference line (39);

a first engaging groove portion (31) which is provided in a first oblique surface (14*b*) of said engaging projection (14) of said control handle (10) and engaged with said engaging upwardly protruding portions (33, 34) of said laminated leaf spring (11) when said control handle (10) projects from said stationary casing (1); and a second engaging groove portion (32) which is provided in a second oblique surface (14*c*) of said engaging projection (14) of said control handle (10) and engaged with said upwardly protruding portions (33, 34) of said laminated leaf spring (11) when said control handle (10) folds into said recess in said stationary casing (1).

2. A door locking handle assembly according to claim 1, wherein said main pin (3) has an intermediate portion provided with an annular groove (26) which is fitted with an o-ring seal (21).

3. A door locking handle assembly according to claim 1, wherein said grip portion (15) of the control handle (10) has a lock unit (22) provided in a front portion of said grip portion (15), and said lock unit (22) includes a rotor (23) having a lock plate (24) attached thereto, so that said lock plate (24) of said lock unit (22) is rotatable into a receiving portion (25) of the stationary casing (1).

4. A door locking handle assembly according to claim 1, wherein said stationary casing (1) is adapted to be mounted on a door (8) by a mounting plate (29) being abutted against a rear surface of the door (8) and attached to the door by a plurality of screws (30) each threadably engaged with the stationary casing (1).

5. A door locking handle assembly of a pull-out and side-swinging lever-action type, comprising:

a stationary casing (1) fixedly mounted on a door (8), said stationary casing (1) being provided with a recess in its front surface and a cylindrical portion (2) in its base-end portion, wherein said cylindrical portion (2) projects rearward from a rear surface of said base-end portion;

a main pin (3) rotatably mounted in said cylindrical portion (2) of said base-end portion of said stationary casing (1) in an insertion manner, said main pin (3) being non-axially slidable in said cylindrical portion (2) and having its rear-end portion fixed to a catch plate (6), wherein said catch plate (6) is engaged with and disengaged from a receiving portion (5) of a stationary frame element (4), and said main pin (3) is provided with a connecting boss portion (7) in its front-end portion;

a control handle (10) which has its base-end portion pivoted to said connecting boss portion (7) of said main pin (3) through a cross pivot (9) so that said control handle (10) is foldable into and projectable from said recess in said stationary casing (1), whereby said control handle (10) is side-swingable in its projected position;

a laminated leaf spring (11) constructed of a pair of an upper and a lower spring element stacked together, wherein said laminated leaf spring (11) is provided with a central through-hole (12) through which said laminated leaf spring (11) is fixedly mounted on said connecting boss portion (7) of said main pin (3), said upper spring element of said laminated leaf spring (11) being provided with a pair of upwardly protruding portions (33, 34) which are diametrically opposite to each other so as to have said central through-hole (12) disposed therebetween, wherein a front surface of said main pin (3) faces a rear surface of said laminated leaf spring (11) and is curved rearwardly to form a concave portion (13);

an engaging projection (14) which is provided in a rear surface of said base-end portion of said control handle (10) and brought into abutting contact with a front surface of said laminated leaf spring (11), wherein after said control handle (10) including its grip portion (15) of said control handle (10) with respect to a reference line (39) extending in a direction perpendicular to a front surface of said door (8), when said control handle (10) is pulled out of said recess in stationary casing (1), said top portion (14*a*) of said engaging projection (14) of said control handle (10) moves across said reference line (39);

a first engaging groove portion (31) which is provided in a first oblique surface (14*b*) of said engaging projection (14) of said control handle (10) and engaged with said engaging upwardly protruding portions (33, 34) of said laminated leaf spring (11) when said control handle (10) projects from said stationary casing (1);

a second engaging groove portion (32) which is provided in a second oblique surface (14*c*) of said engaging projection 914) of said control handle (10) and engaged with said upwardly protruding portions (33,34) of said laminated leaf spring (11) when said control handle (10) folds into said recess in said stationary casing (1);

a lock unit (22) provided in a front portion of said handle grip portion (15), said lock unit (22) including a rotor (23) having a lock plate (24) attached thereto, so that said lock plate (24) is rotatable into a receiving portion (25) of said stationary casing (1); and said stationary casing (1) is mounted on a door (8) by a mounting plate (29) being abutted against a surface of the door (8) and attached thereto by a plurality of screws (30) each threadably engaged in the stationary casing (1).

* * * * *